United States Patent [19]

Fukushima

[11] Patent Number: 5,037,590

[45] Date of Patent: Aug. 6, 1991

[54] METHOD FOR THE PREPARATION OF CARBON FIBERS

[75] Inventor: Ryutaro Fukushima, Chiba, Japan

[73] Assignee: Idemitsu Kosan Company Limited, Tokyo, Japan

[21] Appl. No.: 531,075

[22] Filed: May 31, 1990

[51] Int. Cl.[5] ..... D01F 9/155

[52] U.S. Cl. ..... 264/29.2; 264/82; 264/83; 264/211.11; 423/447.4; 423/447.7

[58] Field of Search ..... 264/29.2, 82, 83, 211.11; 423/447.1, 447.2, 447.6, 447.7, 447.4

[56] References Cited

U.S. PATENT DOCUMENTS 4,822,587 4/1989 Hino et al. ..... 423/447.1

FOREIGN PATENT DOCUMENTS 48-42696 12/1973 Japan .
55-90621 7/1980 Japan .
58-53085 11/1983 Japan .
60-120112 6/1985 Japan .
60-238520 11/1985 Japan .
60-259629 12/1985 Japan .
63-145419 6/1988 Japan .
63-264917 11/1988 Japan .

*Primary Examiner*—Hubert C. Lorin
*Attorney, Agent, or Firm*—Wyatt, Gerber, Burke & Badie

[57] ABSTRACT

A method is proposed for the preparation of pitch-based carbon fibers having excellent mechanical properties or , in particular, a surprisingly high knot strength much higher than that of PAN-based carbon fibers. The method comprises the steps of melt-spinning of starting pitch material, infusibilization of the pitch fibers by oxidation and carbonization of the infusibilized pitch fibers in an inert atmosphere. The improvement of the inventive method consists in the infusibilization treatment of pitch fibers under controlled conditions so as to effect preferential oxidation of the surface layer to such an extent that the value $m=(O_{1s}/C_{1s})/(O/C)$ is at least 2, in which $O_{1S}/C_{1S}$ is the molar ratio of the oxygen content to the carbon content in the surface layer as determined by the ESCA method and O/C is the molar ratio or the oxygen content to the carbon content for the infusibilized pitch fiber as a whole.

2 Claims, 3 Drawing Sheets

METHOD FOR THE PREPARATION OF CARBON FIBERS

BACKGROUND OF THE INVENTION

The present invention relates to a method for the preparation of carbon fibers. More particularly, the invention relates to an efficient and improved method for the preparation of pitch-based carbon fibers having an extremely high knot strength and outstandingly high tensile strength.

Carbon fibers are highlighted in recent years as a class of important fibrous materials having high tensile strength and elastic modulus despite their lightness so that they are widely used in a rapidly growing quantity as a base material or a resin-reinforcing material in a variety of application fields including parts of aircrafts and automobiles, sporting goods and the like.

Carbon fibers are classified into two classes of so-called PAN-based ones and pitch-based ones dependinq on the starting material for the preparation thereof. The PAN-based carbon fibers are prepared from polyacrylonitrile fibers as the starting material and characterized by their high tensile strength and intermediate elastic modulus. For example, PAN-based carbon fibers may have an elastic modulus of about 400 GPa at the highest after a heat treatment at 2000° C. or above. PAN-based carbon fibers, however, have disadvantages that it is an inherently difficult matter that they are imparted with an extremely high elastic modulus because PAN-based carbon fibers are poorly graphitizable so that the degree of graphitization cannot be high enough in addition to the relatively high costs as compared with pitch-based carbon fibers.

On the other hand, pitch-based carbon fibers are economically advantageous in respect of the low costs because the starting material thereof is an inexpensive carbonaceous pitch. In particular, an extremely high elastic modulus of around 800 Gpa can be obtained in graphitized pitch-based carbon fibers prepared from a liquid-crystalline mesophase pitch and heat-treated at about 3000° C. Though advantageous in respect of the extremely high elastic modulus, pitch-based carbon fibers are not quite satisfactory when high-strength fibers or high-elongation fibers are desired.

It is noted that carbon fibers are required to be fully pliable when carbon fibers are used as a base material of various kinds of composite materials or woven or knit fabrics are prepared therefrom. Accordingly, it is industrially highly desirable that pitch-based carbon fibers, having economical advantages, are imparted with improved tensile strength and knot strength as a measure of the pliability. Thus, it is eagerly desired to develop a method for the preparation of pitch-based carbon fibers having greatly improved tensile strength and knot strength.

The manufacturing process of pitch-based carbon fibers usually includes the steps of melt-spinning of a carbonaceous pitch into pitch fibers, infusibilization of the pitch fibers and carbonization of the infusibilized pitch fibers. Various attempts and proposals have been hitherto made for improvement of each of these steps. As to the infusibilization treatment of pitch fibers, for example, (1) Japanese Patent Publication No. 48-42696 and Japanese Patent Kokai No. 55-90621, No. 58-53085 and No. 60-259629 teach a method in which pitch fibers are heated in an atmosphere of air containing nitrogen dioxide $NO_2$, (2) Japanese Patent Kokai No. 63-120112 teaches a method in which carbon fibers of high elastic modulus can be prepared at a lower temperature than in the prior art methods by first selectively infusibilizing the surface layer alone of the pitch fibers and enhancing the crystallinity in the core portion of the fibers, (3) Japanese Patent Kokai No. 63-145419 teaches a method according to which carbon fibers of high strength can be prepared by the infusibilization treatment for a relatively long time at a low temperature of 200° C., (4) Japanese Patent Kokai No. 63-264917 teaches a method for the infusibilization of pitch fibers in which the length of time taken for the treatment can be shortened when the treatment is conducted at a temperature not exceeding 350° C. in an atmosphere of an oxygen-enriched gas containing at least 30% by volume of oxygen, and so on.

These prior art proposals relative to the infusibilization treatment of pitch fibers, however, are not always quite satisfactory from the standpoint of achieving the above mentioned object of the invention. For example, the method (1) is ineffective as a method for the preparation of high-performance carbon fibers since the object of the improvement is directed to the production efficiency. Each of the methods (2) to (4) is indeed effective in obtaining carbon fibers of high strength or high elastic modulus but almost no improvement can be expected thereby in respect of the pliability of the fibers.

As to the step of spinning of a molten carbonaceous pitch material, it is known that a pitch fiber may have a specific internal structure by controlling the spinning conditions. The structure of the carbon fibers disclosed in Japanese Patent Kokai No. 60-238520 is radial in the surface layer portion and onion-like in the core portion. No substantial improvements, however, can be obtained in these carbon fibers having a modified structure in respect of the pliability of the fibers.

SUMMARY OF THE INVENTION

The present invention accordingly has an object to provide a novel and improved method for the preparation of high-performance pitch-based carbon fibers greatly enhanced, in particular, in the tensile strength and knot strength by overcoming the above described problems in the prior art methods.

Thus, the method of the invention for the preparation of pitch-based carbon fibers, which has been established as a result of the extensive investigations undertaken by the inventor with the above mentioned object, comprises the steps of:

(a) spinning a melt of a carbonaceous pitch material into pitch fibers;

(b) infusibilizing the pitch fibers by heating in an oxidizing atmosphere; and (c) carbonizing the infusibilized pitch fibers by heating in an inert atmosphere, in which the infusibilization treatment of the pitch fibers in step (b) is conducted to such an extent that the surface layer of each of the pitch fibers is preferentially oxidized relative to the core portion so as to give a value of m of at least 2, where m is given by the equation $$m=(O_{1\,s}/C_{1\,s})/(O/C),$$

in which $O_{1\,s}/C_{1\,s}$ is the ratio of the oxygen content to the carbon content by moles in the surface layer and O/C is the ratio of the oxygen content to the carbon content by moles in the carbon fiber as a whole, the value of $O_{1s}/C_{1s}$ being determined by the method of X-ray photoelectron spectrometry (XPS=ESCA).

The infusibilization treatment of the pitch fibers to satisfy the above mentioned requirement can be performed, for example, by heating the pitch fibers in an atmosphere of a gaseous mixture containing 0.1 to 30% by volume of nitrogen dioxide $NO_2$ at a temperature in the range from 150 to 300° C. for 10 to 600 minutes.

BRIEF DESCRIPTION OF THE DRAWING

Each of the figures is a diagram obtained by the EPMA (electron probe microanalyzer) method for the concentration of oxygen within a cross section of an infusibilized pitch fiber.

DETAILED DESCRIPTION OF THE pREFERRED EMBODIMENTS

Figure 1A:
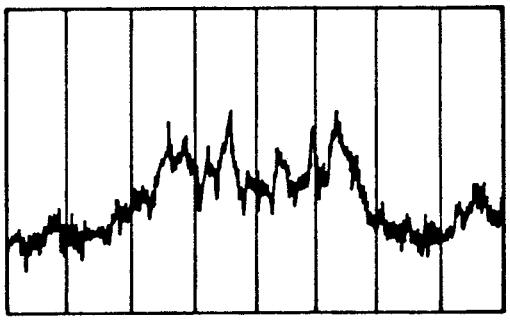
FIGS. 1*a* to 1*d* are each for a pitch fiber infusibilized in air.

As is described above, the most characteristic feature in the inventive method consists in the step of infusibilization of pitch fibers, which is conducted to such an extent that selective infusibilization by oxidation is obtained in the surface layer of the pitch fibers to satisfy the requirement that the oxygen/carbon molar ratio in the surface layer $O_{1s}/C_{1s}$ is at least twice of that for the pitch fiber as a whole O/C.

The starting material used in the inventive method is a carbonaceous pitch which can be a conventional pitch material of any grade provided that fibers can be spun from the melt of the pitch. Examples of usable carbonaceous pitch materials include coal-based pitches, e.g., coal tar pitches, liquefaction products of coals and the like, residual oils of petroleums, e.g., tar pitches by naphtha cracking, tar pitches by catalytic cracking of crude oils, residues from topping, distillation residues under reduced pressure and the like, and synthetic pitches obtained by the thermal decomposition of synthetic resins as well as hydrogenated products of these pitches with hydrogen or a hydrogen-donor compound, modification products of these pitches by a heat treatment or solvent extraction and so on. These carbonaceous pitches can be optically isotropic or anisotropic and so-called neomesophase pitches and premesophase pitches can also be used as the starting material in the inventive method. It is preferable to use an optically anisotropic carbonaceous pitch having a softening point in the range from 200 to 400° C. or, more preferably, from 230 to 380° C.

The first step of the inventive method, i.e. step (a), is melt-spinning of the starting carbonaceous pitch to prepare pitch fibers. The melt-spinning of the pitch can be performed under conditions not particularly limitative and according to a conventional procedure. For example, the carbonaceous pitch is heated and molten at a temperature higher by 10 to 40° C. than the softening point thereof and the melt is extruded from a spinnerette having holes of 0.1 to 0.5 mm diameter at a velocity of 100 to 2000 meters/minute under a stretching ratio of 100 to 200 times. The thus obtained pitch fibers usually have a diameter in the range from 5 to 15 μm.

In step (b) of the inventive method, the pitch fibers obtained in step (a) are subjected to an infusibilization treatment under controlled conditions so as to give the value of m, which is the ratio of the oxygen/carbon molar ratio in the surface layer of the fiber $O_{1s}/C_{1s}$ to the oxygen/carbon molar ratio for the whole fiber O/C, given by the equation $m=(O_{1s}/C_{1s})/(O/C)$, is at least 2, the value of $O_{1s}/C_{1s}$ for the surface layer being determined by the XPS method.

Conventionally, the infusibilization treatment of pitch fibers is performed by heating the pitch fibers in air at a temperature in the range from 100 to 400° C. to stabilize the fibers by oxidation. When the temperature for the heat treatment is higher than 350° C., however, the combustive oxidation reaction gains increased predominance so that a significant weight loss is caused in the pitch fibers to be imparted with brittleness so that the carbon fibers prepared from the infusibilized pitch fibers cannot have excellent physical properties. Accordingly, the infusibilization treatment of pitch fibers in the prior art methods is conducted, preferably, at a relatively low temperature not exceeding 350° C. or, more preferably, not exceeding 300° C.

Figure 1B:
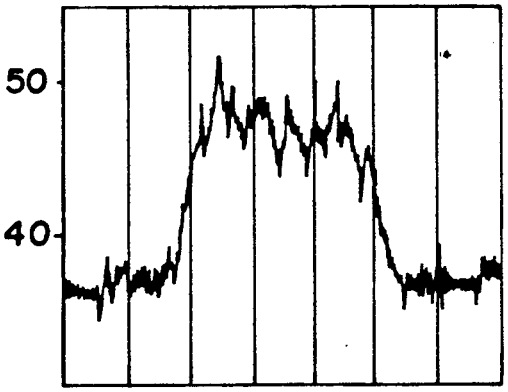
Figure 1C:
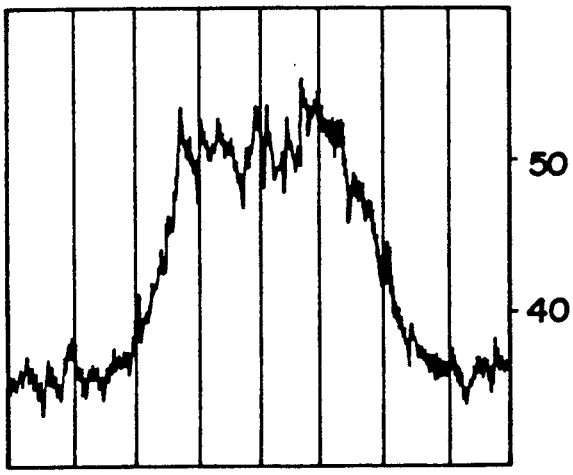
Figure 1D:
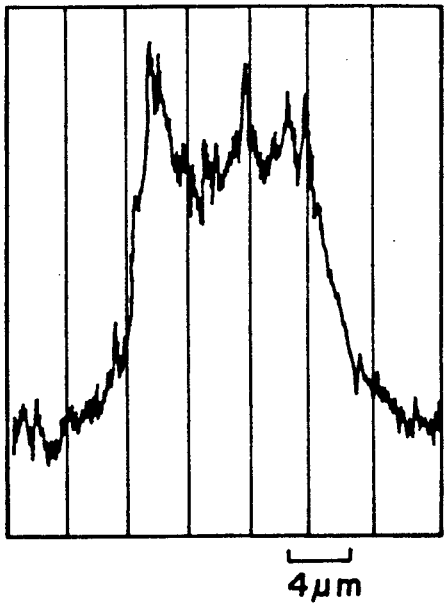

When the infusibilization treatment is carried out at a relatively low temperature as is mentioned above, the time taken for the treatment must be increased so much that the productivity of the manufacturing process is necessarily decreased. In addition, the rate-determining step in such a low-temperature heat treatment is the reaction and not the diffusion of oxygen when the fiber diameter is in the range from 5 to 15 μm so that intrusion of oxygen takes place uniformly throughout the cross section of the fiber radially from the surface to the core portion or center of the cross section. This situation is well demonstrated in FIGS. 1*a* to 1*d* each showing the diagram taken by using an EPMA for the content of oxygen within a cross section along a diameter. The conditions of the heat treatment and the overall oxygen content in the infusibilized pitch fibers are as follows in each of FIGS. 1*a* to 1*d*. Thus, the pitch fiber shown in FIG. 1*a* was obtained by the heat treatment of a pitch fiber at a rate of temperature elevation of 10° C. per minute from 200 to 280° C. followed by immediate cooling from 280° C. thus to give an overall oxygen content of 3.8% by weight. In FIG. 1*b*, the temperature was increased in the same way as above but the temperature of 280° C. was maintained for 30 minutes before cooling thus to give an overall oxygen content of 9.2% by weight. The temperature profile for FIG. 1*c* was the same as for FIG. 1*b* except that the length of the time for keeping the temperature at 280° C. was extended to 60 minutes thus to give an overall oxygen content of 12.4% by weight. Finally, the temperature profile for FIG. 1*d* was the same as for FIG. 1*b* except that the length of time for keeping the temperature at 280° C. was extended to 90 minutes thus to give an overall oxygen content of 15.5% by weight. It is clear from these figures that the core portion of the infusibilized pitch fiber contains a large amount of oxygen after the infusibilization treatment so that the oxygen in the core portion is necessarily released in the subsequent carbonization step in the form of a gaseous product such as water vapor, carbon dioxide, carbon monoxide and the like. Therefore, the carbon fibers obtained by the carbonization step necessarily have a defect of microscopic voids formed by the release of the above mentioned oxygen-containing gases.

In the method of the invention, the above mentioned drawbacks in the structure of the carbon fibers after carbonization can be avoided by conducting the heat treatment for infusibilization at a relatively low temperature not to cause the combustive oxidation reaction and to effect the oxidation reaction selectively in the surface layer so that the value of the above defined m is at least 2 after the infusibilization treatment. A value of m smaller than 2 means that the oxidation of the pitch fiber in the surface layer is insufficient as compared with the core portion or the pitch fiber has been fully oxidized not only in the surface layer but also in the core portion. At any rate, carbon fibers having a high tensile strength and high knot strength cannot be obtained by the carbonization treatment of such inappropriately infusibilized pitch fibers.

The infusibilization treatment of pitch fibers to satisfy the above mentioned requirement is performed, for example, by heating the pitch fibers in an atmosphere containing from 0.1 to 30% by volume or, preferably, from 0.8 to 8% by volume of nitrogen dioxide $NO_2$ at a temperature in the range from 150 to 300° C. or, preferably, from 180 to 280° C. for a length of time in the range from 10 to 600 minutes or, preferably, from 10 to 240 minutes. The diluent gas with which the nitrogen dioxide is diluted to give a concentration in the above mentioned range is not particularly limitative including air, nitrogen, argon and the like, of which air is preferred in view of the lowest cost. Namely, the atmospheric gas is preferably a gaseous mixture of air and nitrogen dioxide. The exact conditions for the infusibilization treatment should be selected depending on the nature of the starting carbonaceous pitch, the diameter of the pitch fibers and other factors. When the conditions for the infusibilization treatment are outside the above mentioned ranges, various drawbacks in the properties of the carbon fibers as well as an economical disadvantage due to the increase in the production costs are caused. The value of $O_{1s}/C_{1s}$ is determined by the method of X-ray photoelectron spectroscopy or so-called ESCA method. It is known that the results obtained by this analytical method for the chemical composition in the surface layer are obtained usually for the surface layer having a thickness of about 0.1 μm so that the value of m or $(O_{1s}/C_{1s})/(O/C)$ can be determined without indefiniteness. In addition to the requirement for the value of m, it is preferable that the value of $O_{1s}/C_{1s}$ for the pitch fibers after the infusibilization treatment is in the range from 0.2 to 0.6 or, more preferably, from 0.25 to 0.5 or, still more preferably, from 0.32 to 0.45.

Figure 2A:
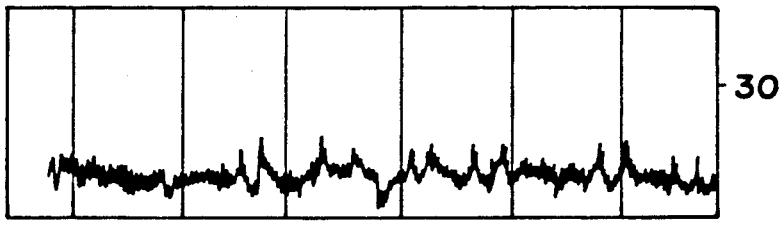
FIGS. 2*a* to 2*d* are each for a pitch fiber infusibilized in air containing nitrogen dioxide.
Figure 2B:
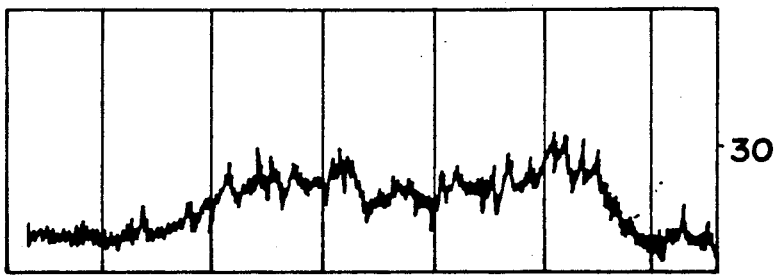
Figure 2C:
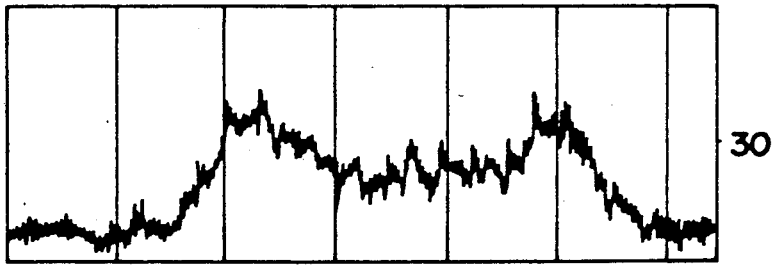
Figure 2D:
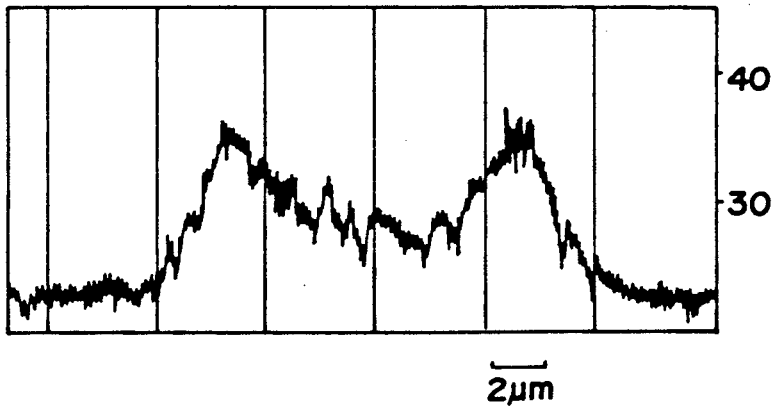

FIGS. 2*a* to 2*d* each show a diagram obtained by the EPMA method for the distribution of oxygen content along a diameter of a pitch fiber within a cross section either before the infusibilization treatment (FIG. 2*a*) or after the infusibilization treatment at 200° C. in an atmosphere of air containing 3% by volume of nitrogen dioxide for a length of time of 60 minutes (FIG. 2*b*), 180 minutes (FIG. 2*c*) and 300 minutes (FIG. 2*d*). The values of m in these infusibilized pitch fibers were 5.5, 3.9 and 2.9 for FIGS. 2*b*, 2*c* and 2*d*, respectively, and the values of $O_{1s}/C_{1s}$ for these infusibilized pitch fibers were, 0.32, 0.36 and 0.42, respectively.

In step (c) of the inventive method, the pitch fibers infusibilized by the preferential oxidation in the surface layer are subjected to a carbonization treatment by heating in an inert atmosphere of, for example, argon or nitrogen at a temperature, usually, in the range from 1000 to 3000° C. for a length of time in the range from 0.1 to 60 minutes. It is sometimes preferable that the above mentioned carbonization treatment is preceded by a pre-carbonization treatment at a temperature in the range from 500 to 1000° C. for a length of time in the range from 5 to 60 minutes.

The carbon fibers prepared according to the above described inventive method usually have a tensile strength of about 3.7 GPa or higher and a knot strength of about 45 N/3K-strand or higher. These values are much higher than the corresponding values of about 2.5 GPa and about 1.3 N/3K-strand in the pitch-based carbon fibers prepared by a conventional method. In particular, a surprising improvement is obtained by the inventive method in the knot strength of the carbon fibers in view of the fact that none of the pitch-based carbon fiber products available on the market has a knot strength exceeding 15 N/3K-strand. The above mentioned value of knot strength in the carbon fibers prepared by the inventive method is much higher even than conventional PAN-based carbon fibers in which the knot strength is around 8.8 N/3K-strand as is the case in a grade of commercial PAN-based carbon fiber product (for example, Toreca T-300, registered trademark for a product by Toray, Inc.).

In the following, the inventive method for the preparation of pitch-based carbon fibers is described in more detail by way of examples which, however, never limit the scope of the invention.

In the following examples and comparative examples, the knot strength of the carbon fibers was determined in the manner described below. Thus, a strand was prepared from 3000-filamented (3K) carbon fibers under testing and the strand, in which a knot is formed in the same manner as in the measurement of the knot strength of a single filament, was held with chucks of a tensile tester to form a chucking length of 25 mm with the knot at the center position between the chucks. The strand with a knot was then pulled at a take-up velocity of 50 mm/minutes to determine the strength at break, which value was converted into the unit of N (newton) and recorded as the knot strength in N/3K-strand.

EXAMPLE 1

A carbonaceous pitch having following property parameters was used as the starting material: content of quinoline-insoluble matters 28.5% by weight; content of the XY-phase 100%; number-average molecular weight 1140; ratio of the weight-average molecular weight Mw to the number-average molecular weight $M_n$ $M_w/M_n=1.45$; and softening point 333° C. The molten pitch kept at a temperature of 358° C. was melt-spun through a spinnerette having 500 holes of 0.15 mm diameter at a take-up velocity of 700 meters/minute to give pitch fibers having a diameter of about 13 μm.

Figure 3A:
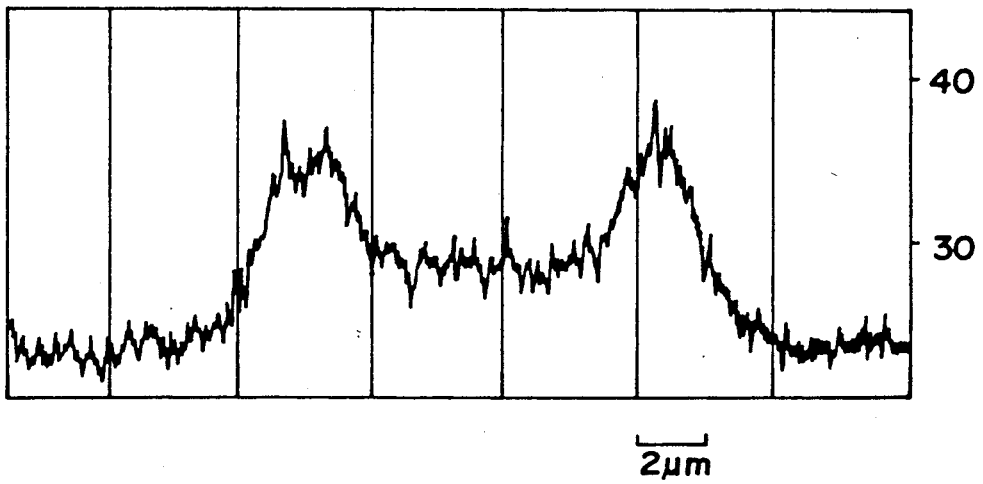
FIGS. 3*a* and 3*b* are each for the infusibilized pitch fiber obtained in Example 1 and Comparative Example 1, respectively. The center point of the abscissa in each figure corresponds to the center in the cross section of the fiber. The ordinate is given in an arbitrary unit corresponding to the counts/seconds in the EPMA method.

The pitch fibers were subjected to an infusibilization treatment by heating in an atmosphere of air containing 1.5% by volume of nitrogen dioxide at a temperature of 220° C. for 180 minutes. According to the results of the ESCA analysis and elemental analysis, the values of $O_{1s}/C_{1s}$ and O/C of these infusibilized pitch fibers were 0.36 and 0.124, respectively, so that the value of m was 2.9. FIG. 3*a* is a diagram obtained in the analysis by the EPMA method for the distribution of the oxygen content within a cross section of the infusibilized pitch fiber along a diameter. As is clear from this figure, the oxygen content within the cross section of the infusibilized pitch fiber is the highest at the very surface within the reach by the ESCA method and rapidly decreases in the radial direction toward the center axis indicating that the oxidation of the pitch fiber proceeds preferentially in the surface layer.

In the next place, the infusibilized pitch fibers obtained in the above described manner were subjected to a carbonization treatment by heating in an atmosphere of nitrogen by increasing the temperature at a rate of 10° C./minute to reach 1550° C. and maintaining this temperature for 10 minutes. The thus prepared carbon fibers had a diameter of about 10 μm. Table 1 below summarizes several physical properties of the carbon fibers obtained as described above. Table 1 also shows corresponding data of physical properties of several commercial products of pitch-based and PAN-based carbon fibers including Carbonic HM-60 (a product by Petoca Co.), Thornel P-25W (a product by Amoco Co.), Thornel P-55S (a product by the same company supra) and Toreca T-300 (a product by Toray, Inc.), the former three being pitch-based carbon fiber products and the fourth one being a PAN-based carbon fiber product. As is clear from comparison with these commercial carbon fibers, the carbon fibers prepared by the inventive method have excellent physical properties and, in particular, an outstandingly high knot strength.

COMPARATIVE EXAMPLE 1

The procedure for the preparation of carbon fibers was substantially the same as in Example 1 except that the infusibilization treatment was conducted in an atmosphere of air by increasing the temperature from 200 to 280° C. at a rate of 10° C./minute and maintaining the temperature of 280° C. for 60 minutes.

Figure 3B:
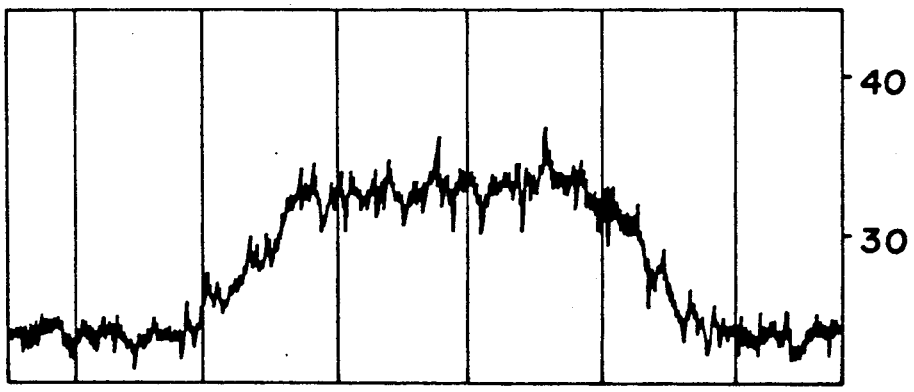

The thus infusibilized pitch fibers had values of $O_{1s}/C_{1s}$ and O/C of 0.15 and 0.097, respectively, so that the value of m was 1.55. FIG. 3*b* is a diagram obtained in the analysis by the EPMA method for the distribution of the oxygen content within a cross section of the infusibilized pitch fiber along a diameter. As is clear from this figure, the oxygen content within the cross section of the infusibilized pitch fiber was relatively uniform throughout the cross section indicating that the oxidation of the pitch fiber took place non-preferentially.

Table 1 below also summarizes the data of the physical properties of the thus prepared comparative carbon fibers. As is understood from these data, the carbon fibers prepared in this comparative example were inferior in the tensile strength and, in particular, very inferior in the knot strength as compared with those prepared in Example 1.

EXAMPLE 2

The procedure of melt-spinning was substantially the same as in Example 1 except that the spinnerette holes had a diameter of 0.13 mm and the spinning velocity was 800 meters/minute so that the pitch fibers obtained had a diameter of about 10 μm. The infusibilization treatment of the pitch fibers was conducted at 200° C. for 180 minutes in an atmosphere of air containing 5% by volume of nitrogen dioxide. Otherwise, the conditions for the preparation of carbon fibers were the same as in Example 1.

The pitch fibers after the infusibilization treatment had values of $O_{1s}/C_{1s}$ and O/C of 0.41 and 0.143, respectively, so that the value of m was 2.86. Several physical properties of the thus prepared carbon fibers are shown in Table 1 below, from which it is understood that the carbon fibers had an outstandingly high knot strength.

TABLE 1

| | Diameter of carbon fiber, μm | Knot strength, N/3K-strand | Tensile strength, GPa | Elastic modulus, GPa | Elongation, % |
|---|---|---|---|---|---|
| Example 1 | 10 | 45 | 3.7 | 250 | 1.5 |
| Example 2 | 7.4 | 21 | 3.7 | 250 | 1.5 |
| Comparative Example 1 | 10 | 1.3 | 2.5 | 250 | 1.0 |
| Carbonic HM60 | 10 | 0.53 | 2.9 | 590 | 0.5 |
| Thornel P-25W | 11 | 11 | 1.3 | 150 | 0.9 |
| Thornel P-55S | 11 | 42 | 1.7 | 370 | 0.5 |
| Toreca T-300 | 7.0 | 8.8 | 3.5 | 230 | 1.5 |

What is claimed is:

1. A method for the preparation of pitch-based carbon fibers which comprises the steps of:

(a) spinning a melt of a carbonaceous pitch material into pitch fibers;

(b) infusibilizing the pitch fibers by heating in an atmosphere of a gaseous mixture containing 0.1 to 30% by volume of nitrogen dioxide $NO_2$ at a temperature in the range of from 150 to 300° C. for 10 to 600 minutes; and (c) carbonizing the infusibilized pitch fibers by heating in an inert atmosphere, in which the infusibilization treatment of the pitch fibers in step (b) is conducted to such an extent that the surface layer of each of the fibers is preferentially oxidized relative to the core portion so as to give a value of m of at least 2, where m is given by the equation $$m=(O_{1s}/C_{1s})/(O/C)$$

in which $O_{1s}/C_{1s}$ is the ratio of the oxygen content to the carbon content by moles in the surface layer and ranges from 0.2 to 0.6 and O/C is the ratio of the oxygen content to the carbon content by moles in the carbon fiber as a whole, the value of $O_{1s}/C_{1s}$ being determined by the method of X-ray photoelectron spectrometry.

2. The method for the preparation of pitch-based carbon fibers as claimed in claim 1 wherein the gaseous mixture is a mixture of air and nitrogen dioxide.

* * * * *